United States Patent [19]

Fanson et al.

[11] Patent Number: 4,646,545

[45] Date of Patent: Mar. 3, 1987

[54] BALANCING RING AND ATTACHMENT MEANS FOR AUTOMATIC WASHER

[75] Inventors: Richard L. Fanson, St. Joseph Township, Berrien County; William L. Kennedy, Coloma Township, Berrien County, both of Mich.

[73] Assignee: Whirlpool Corporation, Benton Harbor, Mich.

[21] Appl. No.: 727,755

[22] Filed: Apr. 26, 1985

[51] Int. Cl.[4] ..... D06F 37/24

[52] U.S. Cl. ..... 68/23.2

[58] Field of Search ..... 68/23.2, 23.3; 494/82; 210/144, 363, 364; 73/573 R, 573 F

[56] References Cited

U.S. PATENT DOCUMENTS

| | | | |
|---|---|---|---|
| 796,220 | 8/1905 | Jones . | |
| 2,822,559 | 4/1955 | Manville . | |
| 2,836,083 | 5/1958 | Smith . | |
| 2,936,184 | 5/1960 | Epstein . | |
| 3,321,997 | 5/1967 | Peterson . | |
| 3,334,497 | 8/1967 | Waldrop . | |
| 3,462,198 | 8/1969 | Onufer . | |
| 3,527,904 | 9/1970 | Worst . | |
| 3,610,069 | 11/1969 | Tanner . | |
| 4,044,626 | 8/1977 | Hayashi et al. . | |
| 4,117,742 | 10/1978 | Stein | 74/573 R |
| 4,162,621 | 7/1979 | Stone . | |
| 4,202,187 | 5/1980 | Hukuzawa et al. . | |
| 4,388,841 | 6/1983 | Gamble . | |
| 4,423,608 | 1/1984 | Funaki . | |
| 4,433,592 | 2/1984 | Tatsumi et al. . | |

FOREIGN PATENT DOCUMENTS

| | | | |
|---|---|---|---|
| 21064 | 2/1979 | Japan | 68/23.2 |

*Primary Examiner*—Philip R. Coe

*Attorney, Agent, or Firm*—Hill, Van Santen, Steadman & Simpson

[57] ABSTRACT

An attachment arrangement is provided between a wash basket and a balancing ring of an automatic washer which permits the ring to be locked onto the basket upon rotation of the ring relative to the basket. The degree of interlocking is increased during normal operation of the washer in that the attachment arrangement is comprised of mating ramp surfaces on the basket and ring which increasingly engage upon relative rotation and at least one tab on the ring which increasingly engages a lip on the basket upon relative rotation. The tab and ramps are oriented such that braking of the basket at the end of a spin cycle results in increased interlocking of the basket and ring.

12 Claims, 6 Drawing Figures

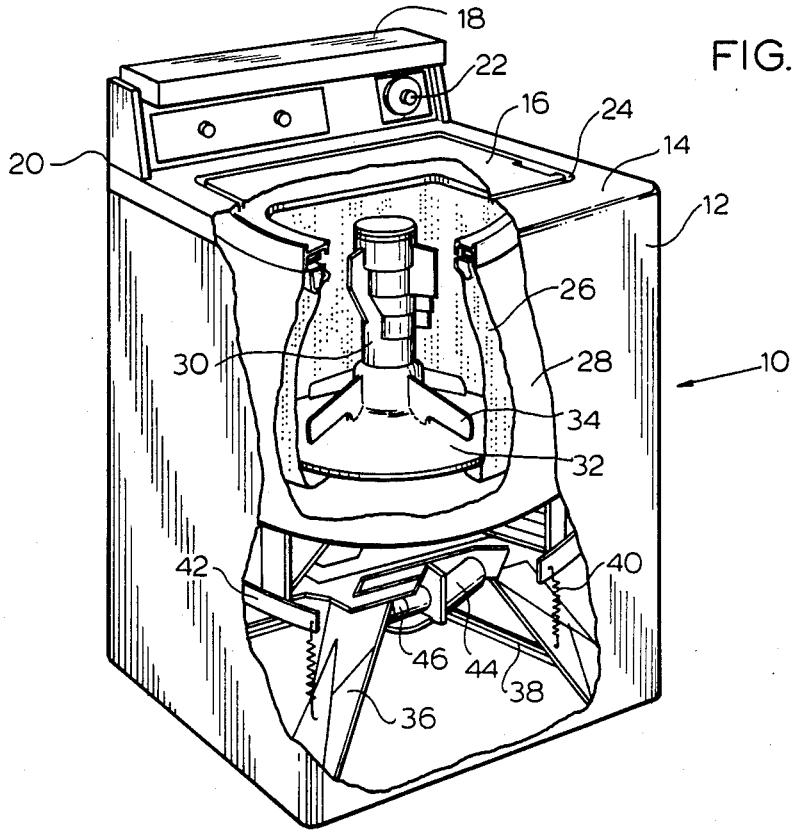
FIG. 1
FIG. 2
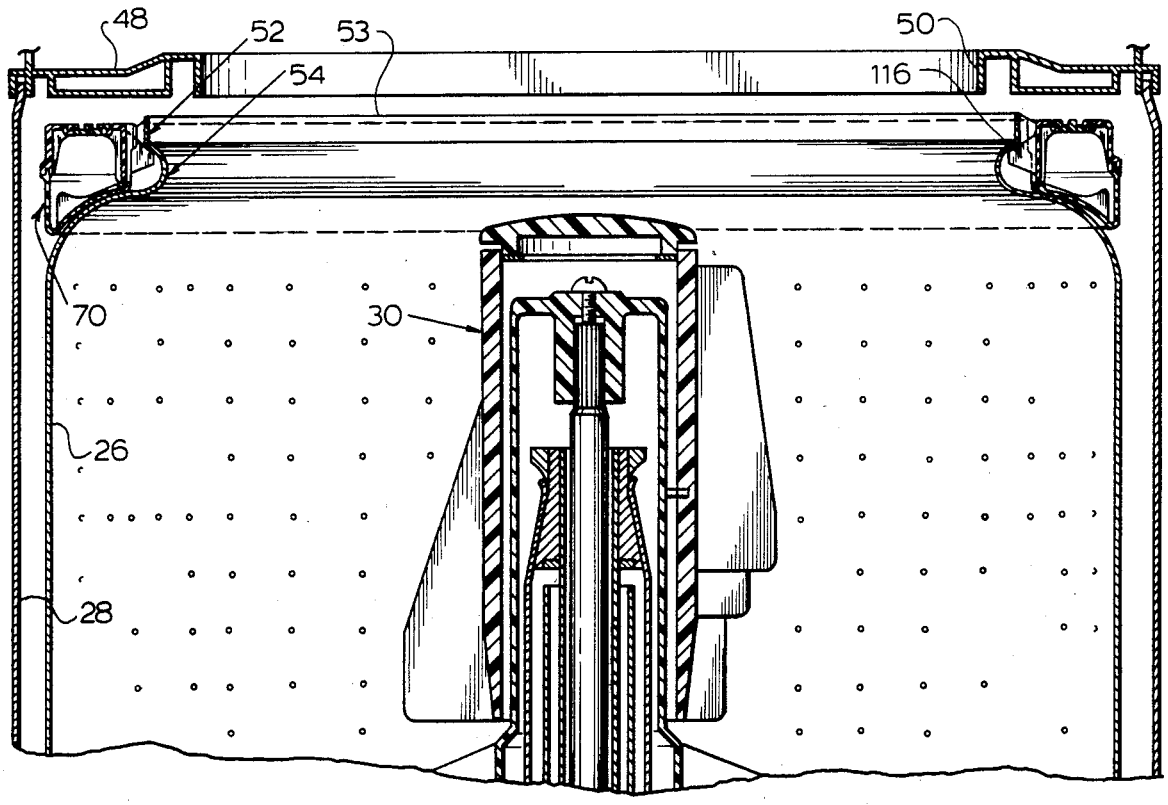

FIG. 3
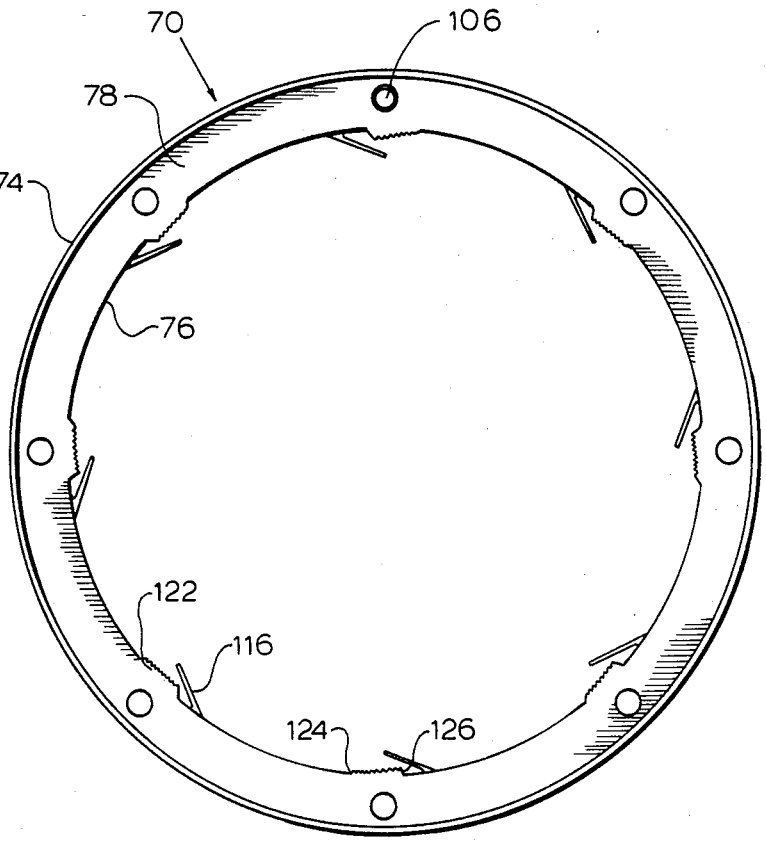
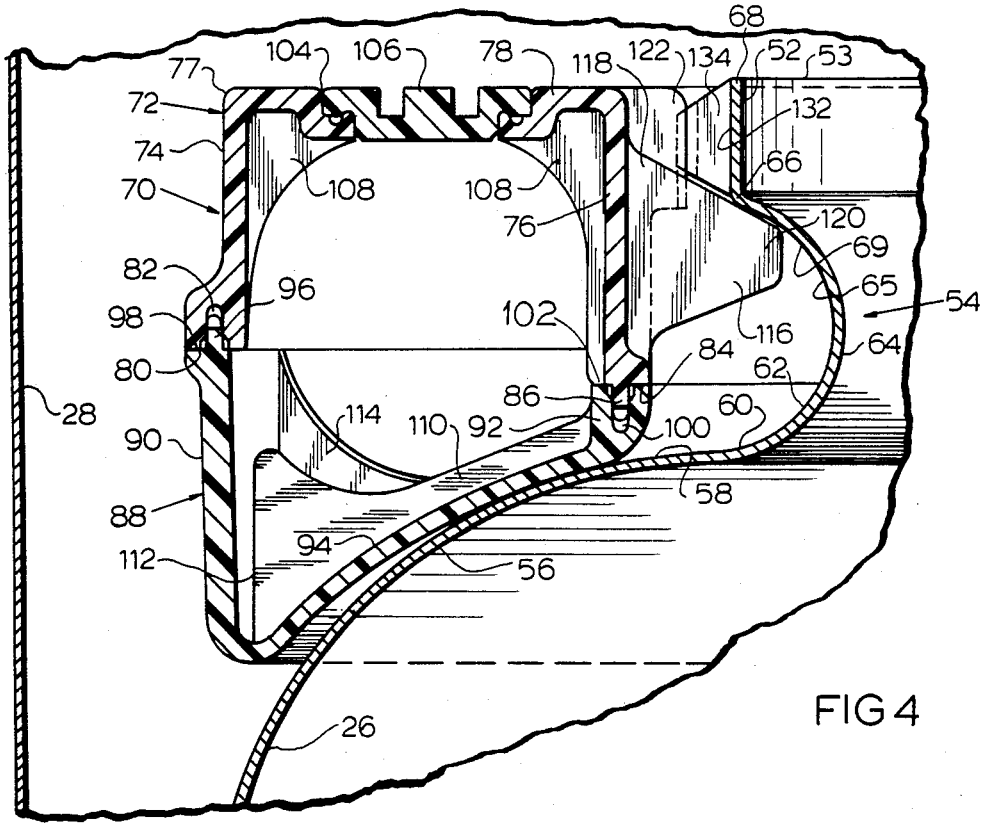
FIG 4

BALANCING RING AND ATTACHMENT MEANS FOR AUTOMATIC WASHER

BACKGROUND OF THE INVENTION

1. Field of the Invention

The present invention relates to washing machines and, more particularly, an improved means for attaching a balancing ring to an automatic washer basket.

2. Description of the Prior Art

It is common practice in an automatic washer to provide a balancing ring around the top periphery of the wash basket to stabilize the basket as it rotates during the high spin mode.

The wash basket is spun with the clothes load during spin operations, and it is important that the balancing ring be securely attached to the basket so that it does not work loose during such operations. Further, the balancing ring must be capable of being securely attached to the basket regardless of manufacturing tolerances which effect the concentricity of the basket.

U.S. Pat. No. 4,433,592 discloses a balance ring which contains both a low viscosity fluid and a plurality of spherical weights to effect balancing during spin. The balancing ring and the spin basket have cooperating flanges and are secured together by means of screws through the flanges.

U.S. Pat. No. 4,388,841 discloses a universal balancing member which comprises a hollow, annular tube member which is secured to the spin basket by means of a plurality of clip members. The clip members each extend around the outer surface of the balancing tube and have an outwardly extending head portion which snaps through a cooperating hole in the upper basket periphery.

U.S. Pat. No. 4,162,621 discloses, incidentally, a balancing ring which is fixed to the upper portion of the basket and contains a granular balancing material. Although details of the construction and attachment means for the balancing ring are not disclosed, it appears that the ring is formed of a metal member which is secured to a metal spin basket, as by welding.

U.S. Pat. No. 3,610,069 discloses a one-piece balancing ring which is designed to receive a solid balancing material, such as concrete. The ring is secured to the basket by means of a plurality of screws so that the ring extends interior of the basket opening.

U.S. Pat. No. 3,462,198 discloses a balancing ring which may be used in connection with an automatic washer or other rotating mechanisms. The balancing ring is secured to the outer surface of the spin basket by means of inwardly extending projections which snap-fit to the holes in the basket. At least a portion of the balance ring can be displaced radially in response to the spinning of the basket.

U.S. Pat. No. 3,334,497 discloses an automatic washer having a balance ring which is spot welded to the inner wall of the basket. The ring contains a solid ballast material, such as cement.

U.S. Pat. No. 2,836,083 discloses a balancing ring containing a thixotropic material which is secured to the outer periphery of the basket by means of brackets which are bolted to the basket.

In each of the prior art disclosures described above, the balance ring is secured to the basket either by welding, a plurality of fasteners such as screws, or other time consuming manual methods, some of which may be insufficient to withstand the constant vibration and the rapid starting and stopping of the spin basket as it moves into and out of the high spin mode.

SUMMARY OF THE INVENTION

The present invention provides a novel attachment means for a balancing ring for an automatic washer. In particular, it is an object of the invention to provide attachment means which allow the ring to be affixed to the upper basket periphery without the need for screws, clips or other fastening means which require separate installation. It is also an object of the invention to provide fastening means which permit the ring to be installed using automated assembly equipment or, alternatively, a minimum of manual labor. It is a further object of the invention to utilize attachment means which can be formed integrally with the ring and with the cooperating portions of the spin basket. It is a still further object of the invention to provide attachment means which are arranged to further interlock or strengthen the attachment between the ring and the spin basket as an incident of normal operation of the machine.

An annular balancing ring is provided which rests on a shoulder of the wash basket surrounding a top opening of the basket. The balancing ring has a plurality of tab means and ramp means which engage with a curled upper lip portion of the basket forming the top opening. The outer periphery of the basket has a plurality of ramp areas comprising chordal depressions and radially outwardly projecting teeth in the ramp areas, spaced around the periphery to cooperate with the tab and ramps of the balancing ring. The balancing ring ramp has a serrated surface engagable with the basket teeth to securely lock the basket and balancing ring preventing corotation therebetween.

The ring is assembled onto the basket by placing it over the basket with the tabs above the basket ramp areas. The basket ramp chordal depression will allow the flexible tabs to collapse when the balancing ring is pushed and rotated in a counter-clockwise direction. The last step is to turn the balancing ring clockwise until the ring ramp teeth engage the basket bumps and the tabs engage the lower portion of the basket lip. It should be noted that the tabs extend in the direction of spin. Upon the conclusion of the spinning operation, the basket is rapidly braked to a stop. The cooperative arrangement of the basket protrusion, the ramp surface and the resilient tab operate to provide a further locking up of the balance ring in the event that it continues to rotate as the basket is braked to a stop.

BRIEF DESCRIPTION OF THE DRAWINGS

FIG. 1 is a perspective view of an automatic washer embodying the principles of the present invention.

FIG. 2 is a partial side sectional view through the interior of the washer showing the balancing ring.

FIG. 3 is a top plan view of the balancing ring.

FIG. 4 is an enlarged partial side sectional view of the installed balancing ring.

DESCRIPTION OF THE PREFERRED EMBODIMENT

Figure 5:
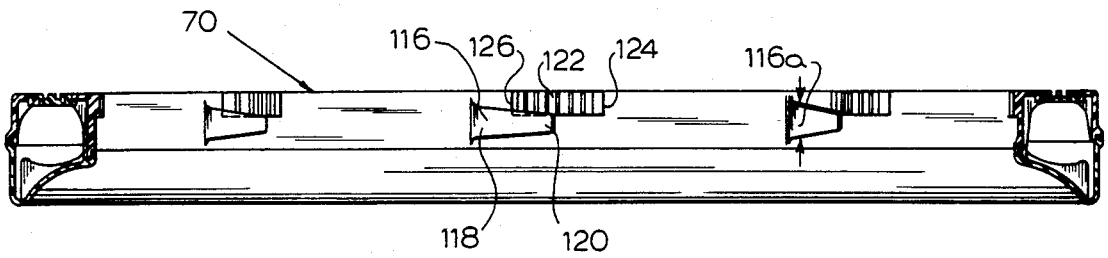
FIG. 5 is a side sectional view of the balancing ring.

In FIG. 1, there is illustrated an automatic washing machine generally at 10 having an exterior cabinet 12 with a top surface 14 and an openable lid 16 forming a portion of the top surface. A control console 18 is positioned at a rear edge 20 of the top panel 14 and has on it a plurality of controls 22 for presetting the operation of the washer to operate through a series of washing, rinsing and drying steps.

Accessible through an opening 24 covered by the lid 16 is a perforate wash basket 26 concentrically mounted within an imperforate wash tub 28. Mounted centrally within the wash basket 26 is a vertical axis agitator 30 having a lower skirt portion 32 and a plurality of radially outwardly extending vanes 34.

The wash tub assembly is carried on supporting legs 36 which are connected to a washer frame 38 interior of the cabinet 12. Shock and vibration absorbing means 40 generally comprising springs are attached between the legs 36 and a plurality of brackets 42 secured to the tub assembly. The agitator 30 and wash basket 26 are selectively oscillated and rotated by means of an electric motor 44 through an appropriate transmission 46.

The interior of the wash basket 26 is shown in greater detail in FIG. 2 which is a cross-sectional view of the upper portion of the wash basket 26. It is clearly seen that the wash basket 26 is mounted concentrically within the wash tub 28 and that the agitator 30 is centrally located. The wash tub 28 has an attached top ring 48 with an opening 50 therein providing access to the interior of the wash basket 26. The wash basket 26 has a substantially circular opening 52 at the top edge 53 thereof which is smaller in diameter than the internal diameter of the wash basket 26 itself in that a curled upper lip 54 is formed at the top end of the basket 26 to form the opening 52.

The curled lip portion 54 is shown in greater detail in FIG. 4 where it is seen that there is a first inwardly curved portion 56 which extends inwardly from the diameter of the wash basket 26 thereby forming an exterior shoulder 58 near a top portion of the wash basket. The slope of the curved portion 56 decreases in a direction toward the top edge 53 of the basket 26 to a transition point 60 from which point the slope increases along a portion 62 through a vertical slope at a neck portion 64, continuing to curve then outwardly along a downwardly facing portion 65 at a substantially equal radius as the portion 62, to a point 66, from whence the basket wall continues vertically upwardly in a portion 68 forming the opening 52. The portion 65 between the narrow neck portion 64 and the transition point 66 to the vertical portion 68 forms a lip 69.

In FIGS. 2 and 4, it is seen that there is provided a balancing ring 70 which is seated on the shoulder portion 58 of the wash basket surrounding the top opening 52 of the basket. The balancing ring 70 has an upper member 72 with an outer annular wall 74 and an inner annular wall 76 connected along a top edge 77 by a top wall 78. A bottom edge 80 of the outer annular wall 74 is enlarged and has an annular groove 82 formed therein and a bottom edge 84 of the inner annular wall 76 has an annular depending ridge 86 projecting therefrom.

The ring member 70 also has a bottom member 88 with an outer annular wall 90 and a relatively short interior annular wall 92 connected by a curved bottom wall 94. The outer annular wall 90 has a ridge portion 96 projecting upwardly from a top edge 98 of the outer wall 90 which mates with the annular groove 82 in the outer wall 74 of the top member 72. The inner wall 92 of the bottom member 88 has an annular groove 100 formed in a top wall 102 thereof to receive the depending ridge 86 of the upper member inner wall 76. The top and bottom members 72, 88 are preferably formed of a molded thermoplastic material and can be permanently joined together such as by spin welding the two portions so that the ridges 86, 96 will be joined to the grooves 100, 82 respectively in a water tight manner. Other fastening methods can be used including adhesives or sonic welding techniques.

The top wall 78 of the top member 72 is formed with at least one opening 104 therethrough sealable by a plug 106 to provide access to the otherwise sealed interior of the balancing ring. Plug 106 may be spin welded in place after the ring has been filled with the desired quantity of water or other balancing fluid.

Molded on the interior of the top member 72 are a plurality of strengthening ribs 108 which extend partially into the interior of the ring member primarily in the areas adjacent the joinder of the top wall 78 to the outer wall 74 and inner wall 76.

Molded within the interior of the bottom portion 88 are a plurality of baffle members 110 which extend from the inner wall 92, along the bottom wall 94 and terminate in an edge 112 just short of the outer wall 90. These baffles 110 alternate with a second type of baffle 114 also molded on the interior of the bottom portion 88 which extend from the inner wall 92 all of the way to the outer wall 90. The profile of all of the baffles combined is such that the majority of the area interior of the ring is left unimpeded, as illustrated in FIG. 4.

Molded on the exterior of the top member 72 and projecting inwardly from the inner wall 76 are a plurality of spaced tabs 116, seen in FIGS. 2–6 which angle away from the inner wall 76 at an accute angle $\alpha$. The tabs 116 have a vertical height dimension 116*a* greater than a thickness 116*b* of the tab, and have a relatively wide base area 118 tapering to a relatively narrow free end 120.

Molded on the exterior surface of the inner wall 76 along the top edge 77 and adjacent each of the tabs 116 is a toothed ramp 122. The ramp 122 is positioned generally adjacent the free end 120 side of the tab 116. The ramp 122 has a first end wall 124 farthest away from the associated tab 116 and a second, relatively taller end wall 126 formed closer to the associated tab. Thus, a surface 128 of the ramp connecting the first end wall 124 with the second end wall 126 provides a sloped, serrated ramp surface, having a plurality of notches or teeth 130 formed therein.

Figure 6:
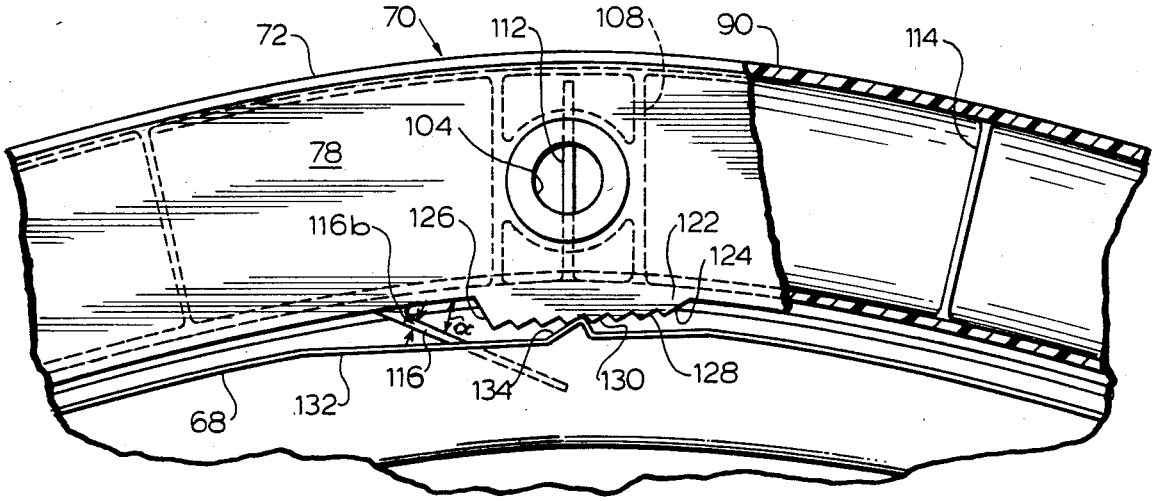
FIG. 6 is a top plan view of the balancing ring assembled onto the wash basket with a portion of the ring cut away.

As best seen in FIG. 6, the vertical wall portion 68 at the top edge 53 of the wash basket 26 is provided with chordal depressions 132 forming ramps at spaced locations around the perimeter of the wash basket opening 52 to coincide with the ramp locations on the balancing ring 70. An outwardly projecting tooth 134 extends from each ramp 132. The tooth 134 on the wash basket ramp 132 projects radially outwardly to engage with the teeth 130 of the ramp 122 formed on the balancing ring 70.

To assemble the balancing ring 70 onto the wash basket 26, the ring is placed over the basket surrounding the basket opening 52 with the tabs 116 above the basket ramp areas 132. The ramp depressions 132 will allow the flexible tabs to collapse when the balancing ring 70 is pushed down toward the shoulder portion 58 of the basket wall and rotated in a counter-clockwise direction. This allows the curved bottom wall 94 of the ring assembly 70 to seat against the shoulder portion 58 of the wash basket. As seen in FIG. 4, the bottom wall 94 of the bottom portion 90 has a concave outer surface to rest on the curved shoulder portion 58 of the washer basket.

The balancing ring is then rotated in a clockwise direction until the ramp teeth 130 engage the tooth 134 on the basket ramp 132 and the tabs 116 engage the lip portion 65 of the basket 26. The angle of the ring ramp 122 results in an increasingly tighter fit as the ring 70 is rotated in the clockwise direction. Also, the increasing height of the tab 116 from the free end 120 to the base 118 results in an increasingly tighter fit between the tab 116 and the basket lip 69 as the ring is rotated in the clockwise direction.

It should be noted that the tabs 116 extend in the direction of spin. Upon the conclusion of the spinning operation, the basket 26 may be rapidly braked to a stop. The cooperative arrangement of the basket tooth 134, the ring ramp 122 and the resilient tab 116 operates to provide a further locking of the balance ring 70 to the wash basket 26 in the event that the ring 70 continues to rotate as the basket 26 is braked to a stop. Thus, it will be appreciated that the cooperating attachment means on the balance ring 70 and the wash basket 26 are arranged to effect an interlocking of the ring and basket when the ring is rotated relative to the basket in the direction of spin. In this manner, the connection between the balance ring 70 and the wash basket 26 is continuously enhanced during the operation of the washer 10.

FIG. 6 shows the spacings of the baffles formed internally of the balancing ring 70. Near the right-hand portion of the figure, the baffle 114 formed in the bottom member 90 is illustrated. The baffle 112 formed in the bottom member 90 is seen in full through the opening 104 formed through the top wall 78 of the top member 72. The baffles 108 formed on the top member 72 are shown in phantom as being closely adjacent to either side of the opening 108. These baffle members act not only to slightly impede the fluid within the ring, but also act as structural strengtheners for the ring.

The ring 70 can be filled with a fluid through the opening 104 to provide the balancing function for the ring. The fluid must be able to move quick enough within the ring to counter-balance an off-balance weight when the basket is accelerating to the top spin speed. For example, if a disproportionate amount of clothing is positioned on one side of the basket, this would result in an off-balance condition. The fluid within the ring would move to an area on the opposite side of the basket, thus counteracting off-balance condition. However, the balancing fluid must be prevented from moving around the balancing ring to create an offbalance condition when there is no off-balance weight. Thus, the internal baffles are used to prevent the unobstructed movement of the liquid within the ring. It has been determined by the Applicants that 50–60% of the balancing ring volume filled with a fluid such as water provides the best overall operating conditions.

It is thus seen that there is provided by the present invention a means for attaching the balancing ring 70 to the wash basket 26 which does not require the usage of additional fasteners which would require additional fastening steps and manufacturing steps, but rather a fastening means is provided which allows for a quick and efficient means to securely attach the balancing ring to the wash basket. The balancing ring can be applied very quickly by manual effort or can be quickly and effectively attached using automated machinery. Further, the fastening means contemplated by the present invention enhances the attachment of the balancing ring to the wash basket during normal operation of the washer. Therefore, periodic checks of the balancing ring are not required.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contributions to the art.

The embodiments of the invention in which an exclusive property or privilege is claimed are defined as follows:

1. In an automatic fabric washing apparatus, an improved rotatable wash basket and a balancing ring assembly comprising:

a wash basket having an opening at a top end thereof;

an annular lip on said basket adjacent said opening;

a balancing ring member sized to rest on said wash basket adjacent said lip;

at least one resilient tab projecting from said ring and being frictionally engageable with said lip upon rotation of said ring relative to said basket to retain said ring on said basket; and, opposed ramp surfaces on said ring member and said lip, said ramp surfaces engaging upon relative rotation between said ring and said basket to retain said tab in frictional engagement with said lip.

2. In an automatic fabric washing apparatus, an improved rotatable wash basket and a balancing ring assembly comprising:

a wash basket having an opening at a top end thereof;

an annular lip on said basket adjacent said opening;

an annular shoulder on said basket below said lip;

at least one ramp area on said basket between said shoulder and said opening;

a balancing ring member sized to extend around said basket;

at least one tab projecting from said ring and being frictionally engagable with said lip;

at least one ramp area on said ring engagable with said basket ramp area to engage said basket ramp area upon rotation of said ring relative to said basket.

3. A washing apparatus according to claim 2 wherein said lip and shoulder are formed on an outer surface of said basket.

4. A washing apparatus according to claim 2 wherein said basket ramp area is formed as a chordal depression in said lip.

5. A washing apparatus according to claim 2 wherein said tab has an angled surface engagable with said lip to increasingly frictionally engage said lip upon said rotation of said ring relative to said basket.

6. A washing apparatus according to claim 5 wherein said tabs project angularly in the direction of the basket spin, thereby causing said tabs to increasingly engage said lip upon rotation of said ring relative to said basket in the direction of spin.

7. A washing apparatus according to claim 2 wherein said basket ramp area and said ring ramp area are provided with a friction enhancement means to increase friction therebetween upon engagement of said ramp areas.

8. A washing apparatus according to claim 7 wherein said friction enhancement means comprises at least one projection formed on each ramp area to engage with the projection on the other.

9. A washing apparatus according to claim 2 wherein said balancing ring is sized to rest on said annular basket shoulder.

10. In an automatic fabric washing apparatus, an improved rotatable wash basket and a balancing ring assembly comprising:

a wash basket having an opening defined by a substantially circular vertical wall at a top end thereof;

an annular lip formed in said basket below said vertical wall;

an annular shoulder formed in said basket below said lip;

a plurality of spaced chordal depressions formed in said vertical wall around the perimeter of said opening;

an outwardly projecting tooth formed in each of said chordal depressions;

an annular ring sized to surround said opening, said ring defining an inner vertical wall and having a bottom wall engagable with said shoulder;

a plurality of spaced resilient tabs formed on said inner wall, said tabs angling away from said inner wall at an acute angle and having a top edge sloped downwardly from an attached base end to a free end thereof, said top edge being engagable with said basket lip;

a plurality of spaced ramp surfaces formed on said inner ring wall, said ramp surfaces having teeth portions engagable with a respective one of said basket teeth formed on said chordal depressions;

whereby said ring can be placed about said opening on said basket shoulder and rotated to selectively lock said tabs against said lip and said ring teeth against said basket teeth.

11. A washing apparatus according to claim 10 wherein said tabs angularly project in the direction of the basket spin causing said tabs to increasingly engage said lip upon braking of said basket at the end of a spin cycle.

12. A washing apparatus according to claim 11 wherein said basket lip defines a generally downwardly facing surface portion and said basket shoulder defines a generally upwardly facing surface portion and wherein said tabs engage said downwardly facing lip portion and said ring bottom wall engages said upwardly facing shoulder portion, whereby said ring is secured between said surface portions so as to prevent vertical movement of said ring relative to said basket.

* * * * *